United States Patent [19]

Drake

[11] Patent Number: 4,663,505

[45] Date of Patent: May 5, 1987

[54] INTERLOCK SWITCH BASE PLATE ASSEMBLY

[75] Inventor: George M. Drake, Shakopee, Minn.

[73] Assignee: Litton Systems, Inc., Beverly Hills, Calif.

[21] Appl. No.: 866,115

[22] Filed: May 22, 1986

[51] Int. Cl.[4] ..... H05B 6/68; H01H 9/00

[52] U.S. Cl. ..... 219/10.55 C; 200/50 A; 200/50 C; 200/61.62; 126/197

[58] Field of Search ..... 219/10.55 C, 10.55 D; 200/50 A, 50 C, 50 R, 5 R, 5 A, 5 B, 5 C, 61.62; 126/197, 194

[56] References Cited

U.S. PATENT DOCUMENTS

| | | | |
|---|---|---|---|
| 4,034,169 | 7/1977 | Armstrong et al. | 200/50 A |
| 4,321,445 | 3/1982 | Kristof et al. | 219/10.55 C |
| 4,516,007 | 7/1985 | Ringdahl et al. | 219/10.55 D X |
| 4,529,852 | 7/1985 | Lewandowski | 200/50 A |
| 4,542,269 | 9/1985 | Sakoda | 219/10.55 C |

OTHER PUBLICATIONS

Interlock Switch Litton Drawing No. 10193-60 Date: 3-12-84.

*Primary Examiner*—Philip H. Leung
*Attorney, Agent, or Firm*—Walter R. Thiel; John M. Haurykiewicz

[57] ABSTRACT

An interlock switch assembly is disclosed having a unitary baseplate having relatively few moving parts and making use of conventional low cost miniature switches, each positively located and retained with respect to the baseplate. First and second actuators convert, respectively, linear motion of first and second operators into rotary motion to actuate the miniature switches. Switch actuation is prevented unless the properly timed motion of both operators is received by the actuators.

10 Claims, 19 Drawing Figures

50b
46
80

34
86
82
84
88
38
5D
50b
5C'
46
5D
5C

80

38

34
86
84
82
88
80

48
90
5F
5F'
50a
52

48

48
90
52
36

INTERLOCK SWITCH BASE PLATE ASSEMBLY

BACKGROUND OF THE INVENTION

In the past, designs of interlock switch assemblies for microwave ovens have progressed from relatively complex assemblies made up of a number of switches individually mounted in sheet metal bracket assemblies requiring individual switch adjustments to custom interlock switch modules containing a plurality of switches positively positioned within a unitary housing. Such custom interlock switch modules reduced the number of adjustments but required relatively costly tooling because of the need for completely redesigned switch elements.

SUMMARY OF THE INVENTION

The present invention overcomes the need for custom designed switch elements, while retaining the advantages of the unitary module approach by providing a unitary baseplate carrying relatively few moving parts compared to previous designs, and by making use of conventional low cost and highly reliable miniature switch elements, each of which is positively located and retained with respect to the baseplate.

BRIEF DESCRIPTION OF THE DRAWINGS

FIG. 4 shows front, side and detail views of the baseplate and assembly views of the actuators.

FIG. 5 shows detail views of the actuators.

DETAILED DESCRIPTION OF THE PREFERRED EMBODIMENTS

Figure 1A:
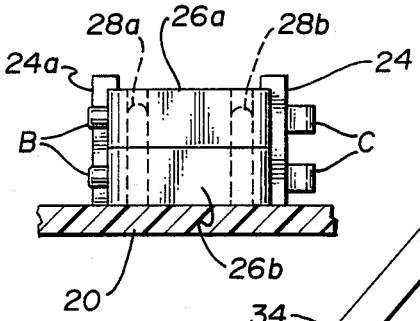
FIG. 1A shows a detail view of the mounting arrangement for a pair of stacked switches.
Figure 1:
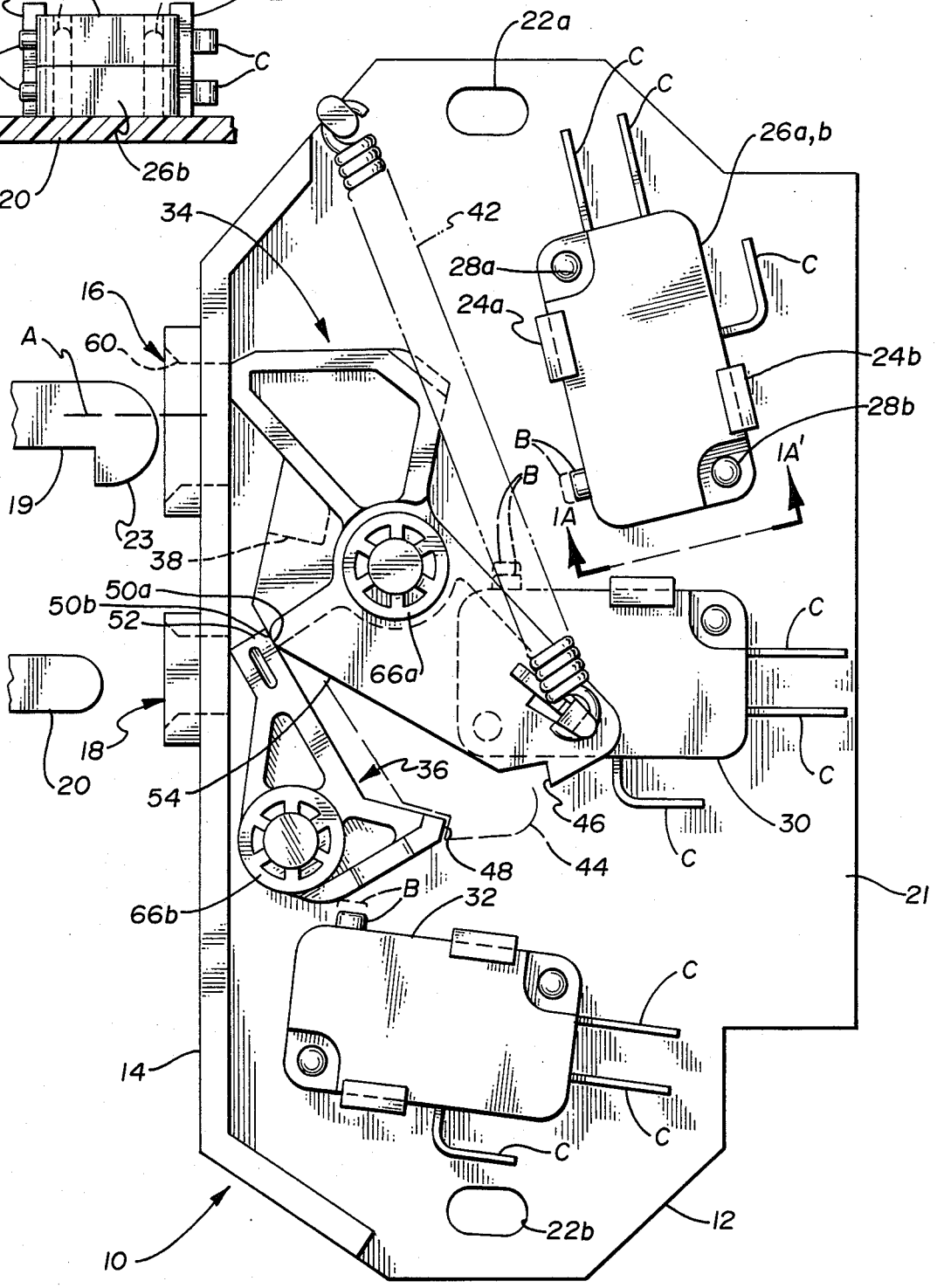
FIG. 1 shows a side view of the interlock switch assembly in the deactuated state.

Referring to FIG. 1, an interlock switch assembly 10 is shown, having a unitary baseplate or frame 12. Frame 12 has a front wall or panel 14 containing first and second apertures 16, 18, respectively adapted to receive first and second operators 19, 20 in a direction parallel to axis A. Operators 19 and 20 are preferably hook-type and bayonet-type operators respectively, and are secured to the door of a microwave oven. Operator 19 preferably has an enlarged distal portion 23 and retains the door in a closed position while the switch assembly is actuated. In FIG. 1, switch assembly 10 is shown in the deactuated state which corresponds to a door-open state of the microwave oven with the operators withdrawn from apertures 16, 18. Frame 12 also has a generally planar wall or mounting surface 21 preferable at a right angle to front wall 14. Surface or base 21 has elongated apertures 22*a,b* adapted for mounting assembly 10 to a microwave oven and for allowing adjustment only along a direction parallel to axis A.

Surface 21 has a pair of rectangular fingers 24*a,b* to positively retain a pair of miniature switches 26*a,b*. Switches 26*a,b* are positively located to assembly 10 at a pair of cylindrical posts 28*a,b*. Fingers 24*a,b* and posts 28*a,b* are preferably integrally molded to base 21. FIG. 1A shows mounting details and the stacked arrangement of switches 26*a,b*. Similar arrangements are provided for individual switches 30 and 32.

Each of switches 26*a,b*, 30, and 32 has an external actuating button B, and means for external electrical connection C. Although three electrical connections are shown for each switch, in the preferred embodiment switch 26*a* is a normally open switch form and functions as a primary interlock, switch 26*b* is a normally open form and functions as a secondary interlock, switch 30 is a normally open form and functions as logic monitor switch, and switch 32 is a normally closed form and functions as an interlcok monitor switch.

A first actuator 34 receives and converts the motion of operator 19 from a linear motion into a rotary motion and sequentially actuates switches 26*a, b* and 30. A second actuator 36 receives and translates the linear motion of operator 20 into a rotary motion to actuate second actuator switch 32. Actuators 34 and 36 are designed to mechanically interlock each other to prevent any switch actuation in the event that only one of operators 19, 20 is received through apertures 16, 18.

Figure 2:
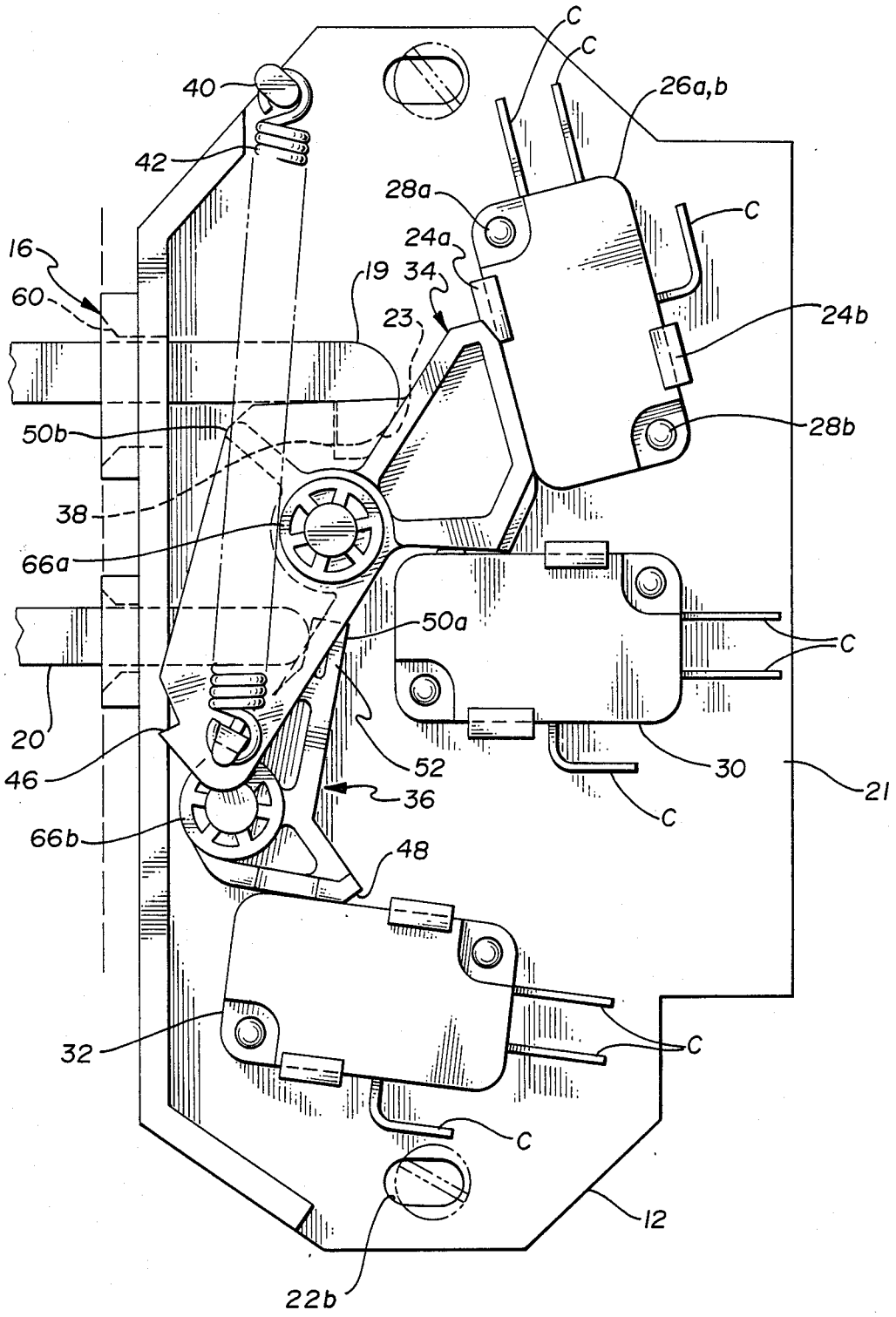
FIG. 2 shows a side view of the interlock switch assembly in the actuated state.

As may be best seen in FIG. 2, once operators 19 and 20 are fully received in assembly 10, all switches are actuated, and because operator 19 is a hook-type operator which engages a surface 38 on actuator 34 hook-type operator 19 is restrained from withdrawal through aperture 16 while the assembly is in the actuated state. FIG. 1 corresponds to a door-open condition of the microwave oven while FIG. 2 corresponds to a closed-door condition of a microwave oven which has operators 19 and 20 rigidly affixed to its access door and switch assembly 10 located behind the front panel 40 of the microwave oven. Although the microwave oven, including operators 19 and 20 and front panel 40 form no part of the interlock switch assembly per se, they are shown as an aid in understanding this invention.

As actuator 34 moves between the deactuated state shown in FIG. 1 and the actuated state shown in FIG. 2, a spring 42 provides an over-center action to retain actuator 34 in either the actuated or the deactuated state.

In the event that an attempt is made to operate assembly 10 by inserting a projection or operator into aperture 16 without a corresponding operator being inserted into aperture 18, actuator 34 progresses to position 44, shown in phantom in FIG. 1. At this point, surfaces 46, 48 on actuators 34, 36 respectively engage each other, prohibiting further travel fo actuator 34.

Alternatively, if an operator is inserted into apertures 18 without a corresponding operator being inserted into aperture 16, interengaging surfaces 50*a,b* prevent motion of actuator 36.

Figure 3:
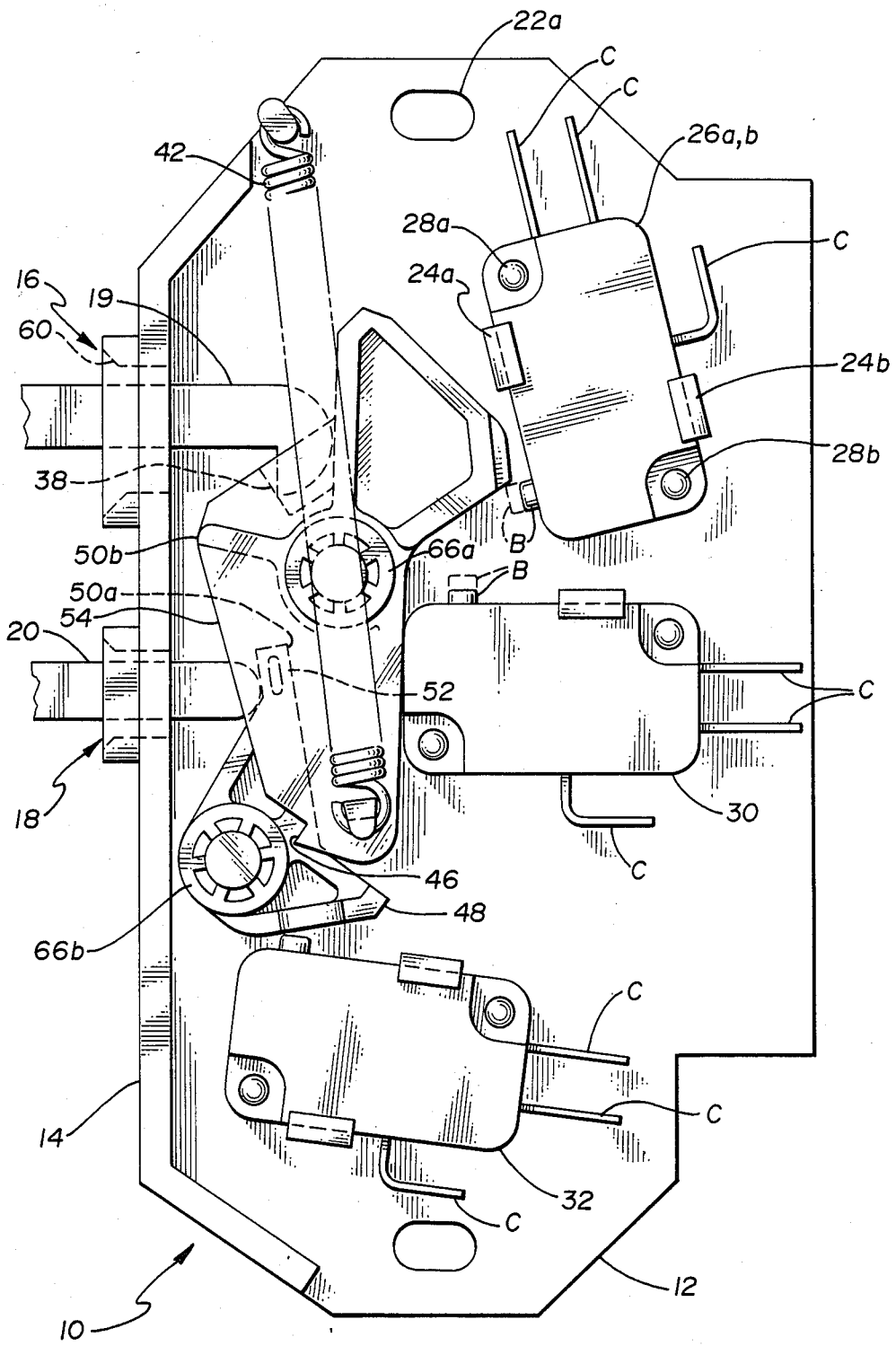
FIG. 3 shows a side view of the interlock switch assembly in a state intermediate the actuated and deactuated states.

During normal operation, as the oven door is closed, operator 19 moves actuator 34 slightly so that surfaces 50*a,b* no longer interengage and projection 52 on actuator 36 is free to enter recess or clearance region 54 in actuator 34 as may be more clearly seen in FIGS. 2 and 3.

FIG. 3 shows interlock switch assembly 10 in an intermediate position with interengaging surfaces 50*a,b* and 46, 48 displaced and free to travel past each other. This action permits actuators 34, 36 to continue to progress to the actuated position as shown in FIG. 2.

FIG. 4 shows various details of baseplate 12. More particularly, FIG. 4A shows a front view of the front wall or panel 14 indicating the relative position of apertures 16 and 18. Preferably, apertures 16 and 18 are surrounded by frames 56, 58 respectively which have a beveled interior surface 60 to assist in receiving operators 19 and 20.

Figure 4D:
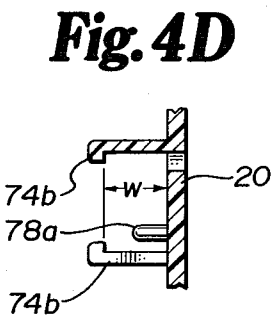
FIG. 4D shows a partial section detail view of switch retaining fingers and locating post for a switch to be mounted on the baseplate.
Figure 4E:
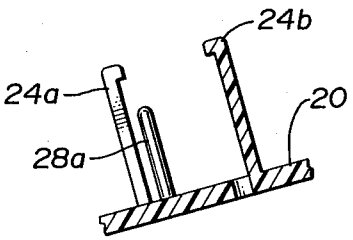
FIG. 4E shows a partial section detail view of fingers and a post for retaining and locating a plurality of switches to be mounted on the baseplate.
Figure 4C:
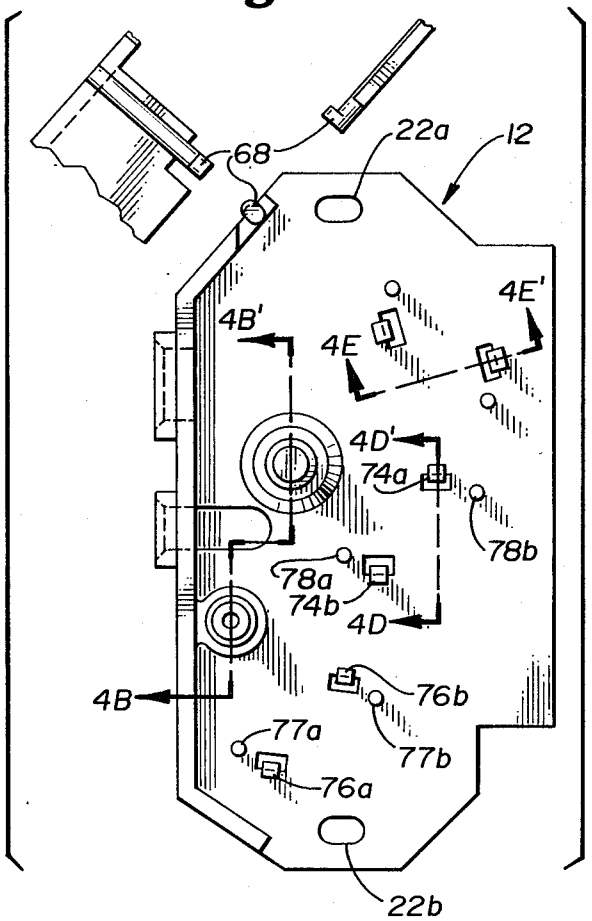
FIG. 4C shows a side view of the baseplate and detail views of a spring-retaining projection on the baseplate.
Figure 4B:
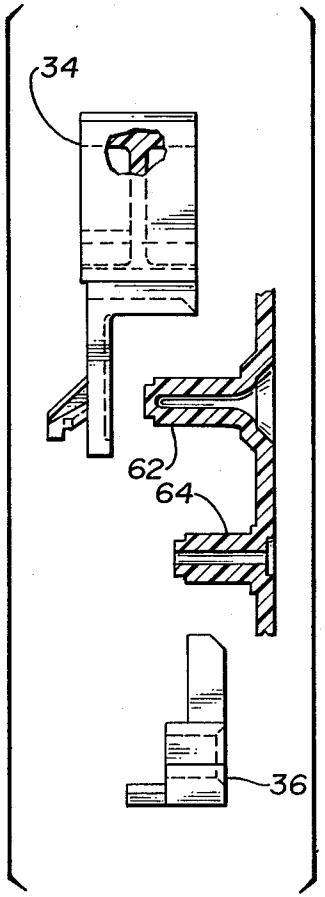
FIG. 4B shows a composite section and exploded view of a portion of the base plate and the mounting arrangement of the actuators.
Figure 4A:
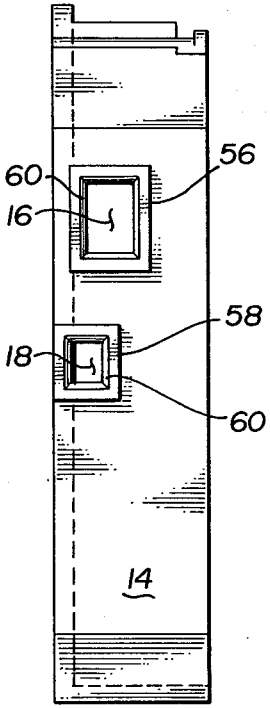
FIG. 4A shows a front view of the baseplate.

FIG. 4B shows a partial section view of frame 12 and further shows an exploded view of the partial assembly including actuators 34 and 36. More particularly, actuator 34 is received on a first shaft 62 and actuator 36 is received on a second shaft 64. Actuators 34 and 36 are retained on their respective shafts by means such as retaining rings 66*a,b* (shown in FIG. 1). Alternatively, other fastening means may be used which restrain axial movement of the actuators while permitting rotational movement.

Referring now more particularly to FIG. 4C, still further details of the baseplate 12 may be seen. A projection 68 shown in top, front and side views is designed to receive and retain one end of spring 42.

The mounting arrangements for the single height and double height stacked switches are shown respectively in FIGS. 4D and 4E. Rectangular fingers 74*a,b* and cylindrical post 78*a* are similar to fingers 24*a,b* and post 28*a*, except that they are shorter by the width W of one miniature switch 26. Fingers 76*a,b* and posts 77*a,b* are preferably the same as fingers 74 and post 78.

Figures 5A, 5B, 5C, 5D, 5E, 5F, 5G, 5H, 5I:
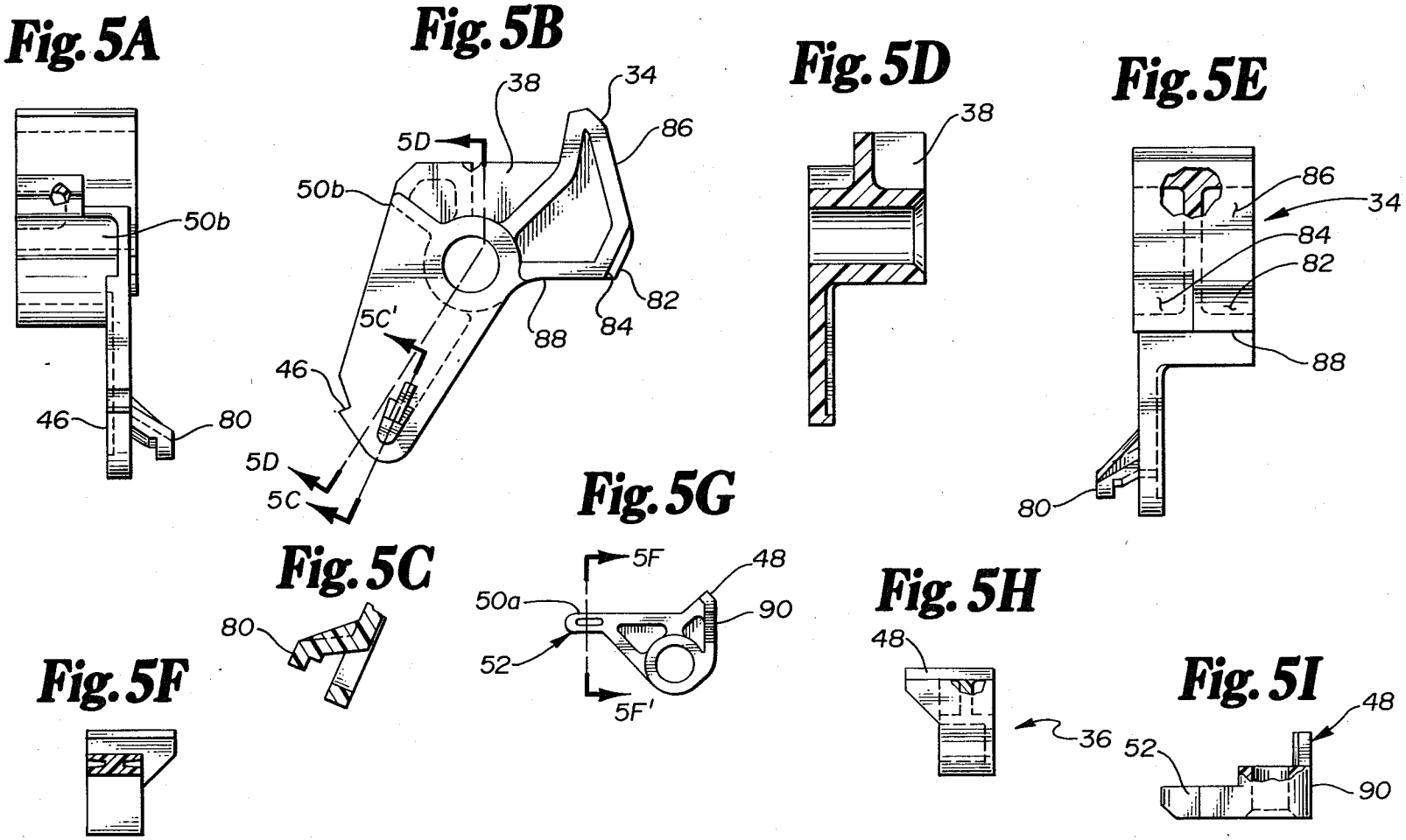
FIG. 5A shows a front view of a first actuator.
FIG. 5B shows a side view of the first actuator.
FIG. 5C shows a partial section view of a spring retaining projection on the first actuator.
FIG. 5D shows another partial section view through the first actuator.
FIG. 5E shows a rear view of the first actuator.
FIG. 5F shows a partial section view through a second actuator.
FIG. 5G shows a side view of the second actuator.
FIG. 5H shows a rear view of the second actuator.
FIG. 5I shows a top view of the second actuator.

Referring now more particularly to FIG. 5, the various details of actuators 34 and 36 may be seen. Interengaging surface 50*b* may be seen in FIG. 5A and 5B. A cross-section of a spring retaining projection 80 on actuator 34 is shown in FIG. 5C. FIG. 5D shows surface 38 which is adapted to retain the hook of operator 19.

FIGS. 5B and 5E shows first and second initial cam surfaces 82,84 and a common final cam surface 86. First initial cam surface 82 engages and actuates switch 26*b* prior to second initial cam surface engaging and actuating switch 26*a*. Subsequently, common final cam surface 86 maintains both switches 26*a,b* actuated. Surface 88 engages and actuates the logic monitor switch 30 located in the mounting assembly of FIG. 4D.

Referring now more particularly to FIGS. 5F–5I, the various views and details of actuator 36 may be seen. FIG. 5F shows a cross-section through projection 52. FIGS. 5G, 5H and 5I show the details of interengaging surfaces 48 and 50*a* which prevent actuation of any switch unless both operators 19 and 20 are received through apertures 16, 18 to operate actuators 34 and 36 in the proper timing sequence. Finally, actuator 36 has a switch contacting surface 90 which actuates switch 32 when actuator 36 is driven to the actuated position by operator 20.

Figure 6:
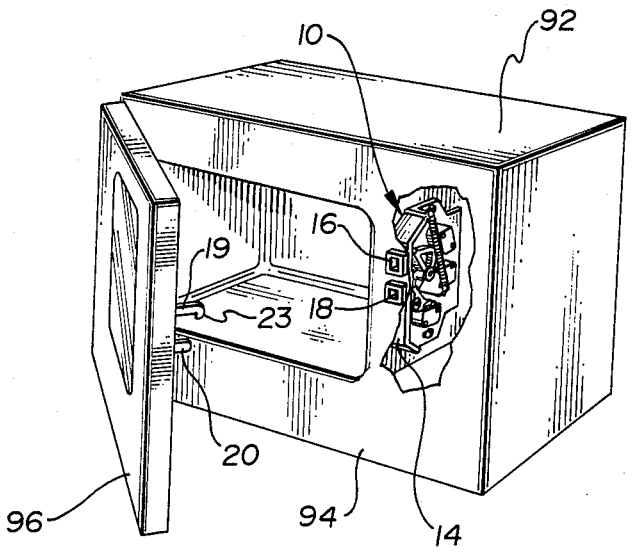
FIG. 6 shows a microwave oven partially cutaway to illustrate the interlock switch baseplate assembly of this invention installed in an oven.

Referring now more particularly to FIG. 6, interlock switch assembly 10 is shown in a microwave oven 92 having a front panel 94 and a pivoting microwave oven door 96. Door 96 carries first and second actuators 19, 20. Assembly 10 is mounted in oven 92 such that first and second apertures 16, 18 located in the front wall 14 of assembly 10 are positioned to protrude through the front panel 94 of oven 92.

The switch assembly 10 deactuation sequence is as follows. When the microwave oven door starts to open, surface 88 releases button B on logic monitor switch 30. If present, switch 30 opens and commands the microwave oven electronic controller to shut off the source of microwave energy. The next switch to be deactuated is the primary interlock switch 26*a* whose button B is released by the second cam surface 84. In microwave ovens without electronic controllers, (and hence without the need for logic monitor switch 30) switch 26*a* is the first switch deactuated and is designed to be capable of interrupting power to the microwave energy source when the door is opened before the cooking cycle is completed. Next, cam surface 82 releases button B on the secondary interlock switch 26*b*, acting as a backup to switch 26*a*. Finally, actuator 36 moves sufficiently far to release button B on the interlock monitor switch 32, thus deactuating switch 32 which places a short circuit across the load side of the power circut of switch assembly 10 to blow a fuse in the event of a "failed-closed" condition of both switches 26*a,b* in the deactuated state.

The invention is not to be taken to be limited to the details of the specification. Variations of the details included in this description are understood to be within the scope of the invention described herein. For example, operator 19 may have alternative geometry for enlarged distal portion 23 such as a ball or any other suitable design to provide the retention function for the microwave open door and to provide deactuation of assembly 10 upon door opening.

What is claimed is:

1. An interlock switch baseplate assembly for use with microwave ovens comprising:

(a) a unitary baseplate having:

(i) a generally planar first surface with a pair of elongated apertures therein for adjustably mounting said baseplate to an adjacent surface;

(ii) a generally planar second surface projecting substantially perpendicularly from said first surface and containing first and second operator apertures therein;

(iii) a plurality of sets of switch location and retention means integrally formed as a part of said baseplate and projecting substantially perpendicularly from said first surface for positively locating and retaining a plurality of switches on said baseplate; and (iv) first and second shaft means integrally formed as a part of said baseplate and projecting substantially perpendicularly from said first surface;

(b) a first actuator positioned on said first shaft means and adapted to receive translational motion of a first operator received through said first operator aperture such that the translational motion of said first operator is converted into rotary motion for sequentially actuating and deactuating a first switch from among said plurality of switches located and retained on said baseplate; and (c) a second actuator positioned on said second shaft means and adapted to receive translational motion of a second operator received through said second operator aperture actuator such that the translational motion of said second operator is converted into rotary motion for actuating and deactuating a second switch from among said plurality of switches located and retained on said baseplate; wherein said first and second actuators have interengaging surfaces which prevent actuation of any switch upon receiving and translational motion of one of the first and second operators without receipt of motion of the other.

2. The assembly of claim 1 further comprising spring means engaged between said first actuator and said baseplate for providing an over-center action for said first actuator when translational motion of both the first and second operators are received through said operator apertures.

3. The assembly of claim 1 wherein said first actuator has a first surface which blocks movement of said second actuator while said first actuator is in a deactuated position.

4. The assembly of claim 3 wherein said first actuator has a clearance region adjacent said first surface of said first actuator which permits movement of said second actuator while said first actuator is in intermediate and actuated positions.

5. The assembly of claim 1 wherein said second actuator has a first surface which blocks said first actuator from moving between intermediate and actuated positions while said second actuator is in a deactuated position.

6. The assembly of claim 5 wherein said second actuator has a clearance region adjacent said first surface of said second actuator which permits movement of said first actuator while said second actuator is in intermediate and actuated positions.

7. The assembly of claim 1 wherein said first actuator has a plurality of cam surfaces for sequentially operating said plurality of switches as said first actuator moves between intermediate and actuated positions.

8. The assembly of claim 1 wherein said second actuator operates said second actuator switch as said second actuator moves between intermediate and actuated positions.

9. An interlock switch baseplate assembly in combination with a microwave oven comprising:

(a) a unitary baseplate having:

(i) a generally planar first surface with a pair of elongated apertures therein for adjustably mounting said baseplate to an adjacent surface;

(ii) a generally planar second surface projecting substantially perpendicularly from said first surface and containing first and second operator apertures therein;

(iii) a plurality of sets of switch location and retention means integrally formed as a part of said baseplate and projecting substantially perpendicularly from said first surface for positively locating and retaining a plurality of switches on said baseplate; and (iv) first and second shaft means integrally formed as a part of said baseplate and projecting substantially perpendicularly from said first surface;

(b) a first actuator positioned on said first shaft means and adapted to receive translational motion of a first operator received through said first operator aperture such that the translational motion of said first operator is converted into rotary motion for sequentially actuating and deactuating a first switch from among said plurality of switches located and retained on said baseplate; and (c) a second actuator positioned on said second shaft means and adapted to receive translational motion of a second operator received through said second operator aperture actuator such that the translational motion of said second operator is converted into rotary motion for actuating and deactuating a second switch from among said plurality of switches located and retained on said baseplate; wherein said first and second actuators have interengaging surfaces which prevent actuator of any switch upon receiving the translational motion of one of the first and second operators without receipt of motion of the other;

(d) said microwave oven having a front panel; and (e) a pivoting microwave oven door having first and second operators projecting therefrom wherein said first operator has an enlarged distal portion.

10. The assembly of claim 9 wherein said first actuator has a surface adapted to receive and retain said distal portion of said first operator when said first actuator is in the actuated position.

* * * * *